US010147535B2

(12) United States Patent
Suzuki et al.

(10) Patent No.: US 10,147,535 B2
(45) Date of Patent: Dec. 4, 2018

(54) ELECTRONIC COMPONENT

(71) Applicants: TOKO, INC., Tsurugashima-shi (JP); MURATA MANUFACTURING CO., LTD., Nagaokakyo-shi (JP)

(72) Inventors: Hironori Suzuki, Nagaokakyo (JP); Takao Kawachi, Ashikaga (JP)

(73) Assignee: Murata Manufacturing Co., Ltd., Nagaokakyo-Shi (JP)

( * ) Notice: Subject to any disclaimer, the term of this patent is extended or adjusted under 35 U.S.C. 154(b) by 0 days.

(21) Appl. No.: 15/112,085

(22) PCT Filed: Jan. 23, 2015

(86) PCT No.: PCT/JP2015/051793

§ 371 (c)(1),
(2) Date: Jul. 15, 2016

(87) PCT Pub. No.: WO2015/115318

PCT Pub. Date: Aug. 6, 2015

(65) Prior Publication Data

US 2016/0343501 A1 Nov. 24, 2016

(30) Foreign Application Priority Data

Jan. 31, 2014 (JP) ..... 2014-016546

(51) Int. Cl.

| | |
|---|---|
| ***H01F 5/00*** | (2006.01) |
| ***H01F 27/29*** | (2006.01) |
| ***H01F 27/28*** | (2006.01) |
| ***H01F 17/04*** | (2006.01) |
| ***H01F 27/255*** | (2006.01) |

(52) U.S. Cl.
CPC ..... *H01F 27/2828* (2013.01); *H01F 5/00* (2013.01); *H01F 17/04* (2013.01); *H01F 27/255* (2013.01); *H01F 27/29* (2013.01); *H01F 27/292* (2013.01); *H01F 2017/048* (2013.01)

(58) Field of Classification Search
CPC ..... H01F 5/00; H01F 27/00–27/36
USPC ..... 336/65, 83, 192, 200, 232–234
See application file for complete search history.

(56) References Cited

U.S. PATENT DOCUMENTS

2009/0250836 A1* 10/2009 Fukui ..... B29C 43/18 264/272.15
2010/0259353 A1* 10/2010 Saito ..... H01F 27/292 336/205

(Continued)

FOREIGN PATENT DOCUMENTS

JP 2010-10544 1/2010
JP 2011-3761 1/2011

(Continued)

*Primary Examiner* — Tuyen Nguyen
(74) *Attorney, Agent, or Firm* — Cozen O'Connor

(57) ABSTRACT

A coil is formed by winding an electrically-conductive wire, and is buried in a molded body formed from a composite magnetic material containing a magnetic powder and a resin. Each of led-out ends of the coil has a cut surface formed by obliquely cutting an electrically-conductive wire with respect to a surface thereof. The cut surface of each led-out end of the coil is exposed on a surface of the molded body, and each led-out end is connected to an external terminal electrode formed in the surface of the molded body at the cut surface.

8 Claims, 2 Drawing Sheets

(56) References Cited

U.S. PATENT DOCUMENTS

| | | | | |
|---|---|---|---|---|
| 2014/0062638 | A1* | 3/2014 | Sasamori | H01F 27/2847<br>336/175 |
| 2016/0055961 | A1* | 2/2016 | Gu | H01F 17/04<br>336/192 |

FOREIGN PATENT DOCUMENTS

| | | |
|---|---|---|
| JP | 2011-9618 | 1/2011 |
| JP | 2015-220272 | 12/2015 |

* cited by examiner

PRIOR ART

ELECTRONIC COMPONENT

RELATED APPLICATIONS

This is a U.S. National Phase Application under 35 USC 371 of International Application PCT/JP2015/051793 filed on Jan. 23, 2015.

This application claims the priority of Japanese application no. 2014-016546 filed Jan. 31, 2014 the entire content of which is hereby incorporated by reference.

TECHNICAL FIELD

The present invention relates to an electronic component, comprising: a coil formed by winding an electrically-conductive wire; and a molded body formed from a composite magnetic material containing a magnetic powder and a resin, wherein the coil is buried in the molded body.

BACKGROUND ART

A conventional electronic component includes a type, as illustrated in FIG. 4, which is obtained by: winding an electrically-conductive wire to form a coil 41; burying a plurality of such a coil 41 in a composite magnetic material containing a magnetic powder and a resin, and cutting the composite magnetic material to form a molded body 42, while exposing led-out ends of the coil 41 on a surface of the molded body 42; forming an external terminal electrode 43 on the surface of the molded body 42 on which the led-out ends 41A, 41B of the coil 41 is exposed; and connecting the led-out ends of the coil 41 to the external terminal electrode (see JP 2011-009618A).

In recent years, this type of electronic component is used, for example, for an inductor or a transformer for a power circuit or a DC/DC converter through which a large electric current flows because the coil can be disposed in a high magnetic permeability material to improve DC superimposition characteristic by using a metallic magnetic powder as the magnetic powder.

In this type of conventional electronic component, the coil is formed by winding the electrically-conductive wire, which makes it possible to diminish a DC resistance as compared to a laminated electronic component.

In the conventional electronic component, each of the led-out ends of the coil is led out at right angle with respect to the surface of the molded body, and thus a contact area of each led-out end of the coil with the external terminal electrode is inevitably determined by a thickness of the electrically-conductive wire. Therefore, the conventional electronic component cannot have a sufficient contact area for a junction of each led-out end of the coil with the external terminal electrode, which leads to a tendency of having an increased DC resistance. To overcome this problem, it is conceivable to have a larger thickness of electrically-conductive wire so as to increase the contact area of each led-out end of the coil with the external terminal electrode. However, such an electronic component becomes undesirably larger in size in an attempt to obtain a predetermined inductance value. Among this type of electronic components, those being compact in size and having a good performance are desired, but it has not been possible for the conventional electronic component to fulfill such a demand.

SUMMARY OF INVENTION

It is therefore an object of the present invention to provide an electronic component capable of preventing a DC resistance from becoming larger due to a junction of each led-out end of a coil with an external terminal electrode, and of improving a strength of connection between each led-out end of the coil and the external terminal electrode, without increasing its size or using any special processes, parts, molds, etc.

According to one or more embodiments of the present invention, an electronic component comprises: a coil formed by winding an electrically-conductive wire; and a molded body formed from a composite magnetic material containing a magnetic powder and a resin, wherein the coil is buried in the molded body, wherein the coil has led-out ends, each having a cut surface formed by obliquely cutting the electrically-conductive wire with respect to a surface thereof, and wherein the cut surface is exposed on a surface of the molded body, and each of the led-out ends is connected to an external terminal electrode formed in the surface of the molded body at the cut surface.

Further, according to one or more embodiments of the present invention, an electronic component comprises: a coil formed by winding an electrically-conductive wire; and a molded body formed from a composite magnetic material containing a magnetic powder and a resin, wherein the coil is buried in the molded body, wherein the coil has led-out ends, each having a cut surface formed by obliquely cutting the electrically-conductive wire with respect to a surface thereof, wherein each of the led-out ends of the coil is led out from an outer periphery of a wound portion of the coil in such a manner as to allow its led-out angle to be greater than 90 degrees with respect to a surface of the molded body, and wherein the cut surface is exposed on a surface of the molded body, and each of the led-out ends is connected to an external terminal electrode formed in the surface of the molded body at the cut surface.

As described above, the electronic component according to one or more embodiments of the present invention comprises: a coil formed by winding an electrically-conductive wire; and a molded body formed from a composite magnetic material containing a magnetic powder and a resin, wherein the coil is buried in the molded body, wherein the coil has led-out ends, each having a cut surface formed by obliquely cutting the electrically-conductive wire with respect to a surface thereof, and wherein the cut surface is exposed on a surface of the molded body, and each of the led-out ends is connected to an external terminal electrode formed in the surface of the molded body at the cut surface. This makes it possible to prevent a DC resistance from becoming larger due to a junction of each led-out end of a coil with an external terminal electrode, and of improving a strength of connection between each led-out end of the coil and the external terminal electrode, without increasing its size or using any special processes, parts, molds, etc.

Further, as described above, the electronic component according to one or more embodiments of the present invention comprises: a coil formed by winding an electrically-conductive wire; and a molded body formed from a composite magnetic material containing a magnetic powder and a resin, wherein the coil is buried in the molded body, wherein the coil has led-out ends, each having a cut surface formed by obliquely cutting the electrically-conductive wire with respect to a surface thereof, wherein each of the led-out ends of the coil is led out from an outer periphery of a wound portion of the coil in such a manner as to allow its led-out angle to be greater than 90 degrees with respect to a surface of the molded body, and wherein the cut surface is exposed on a surface of the molded body, and each of the led-out ends is connected to an external terminal electrode formed in the surface of the molded body at the cut surface. This makes it possible to prevent a DC resistance from becoming larger due to a junction of each led-out end of a coil with an external terminal electrode, and of improving a strength of connection between each led-out end of the coil and the external terminal electrode, without increasing its size or using any special processes, parts, molds, etc.

DESCRIPTION OF EMBODIMENTS

According to one or more embodiments of the present invention, a coil is formed by winding an electrically-conductive wire, and is buried in a molded body formed from a composite magnetic material containing a magnetic powder and a resin. The coil is formed by winding an electrically-conductive wire in such a manner as to allow its led-out ends to be positioned on an outer periphery of a wound portion, and by leading out the led-out ends in opposite directions with each other from the outer periphery of the wound portion. Each led-out end of the coil is led out from the outer periphery of the wound portion of the coil in such a manner as to allow its led-out angle to be greater than 90 degrees with respect to a surface of the molded body. The led-out end is then cut obliquely with respect to a surface of the electrically-conductive wire, while the cut surface is exposed on the surface of the molded body, and the led-out end is connected to an external terminal electrode formed in the surface of the molded body at the cut surface.

Therefore, one or more embodiments of the present invention makes it possible to increase an area of each led-out end of the coil exposed on the surface of the molded body even with an electrically-conductive wire having the same thickness as the conventional one. This allows the coil formed by winding the electrically-conductive wire to be connected to the external terminal electrode formed in the surface of the molded body with a large contact area kept between each led-out end of the coil with the external terminal electrode.

The embodiments of the electronic component of the present invention will be described below with reference to FIGS. 1 to 3.

First Embodiment

Figure 1:
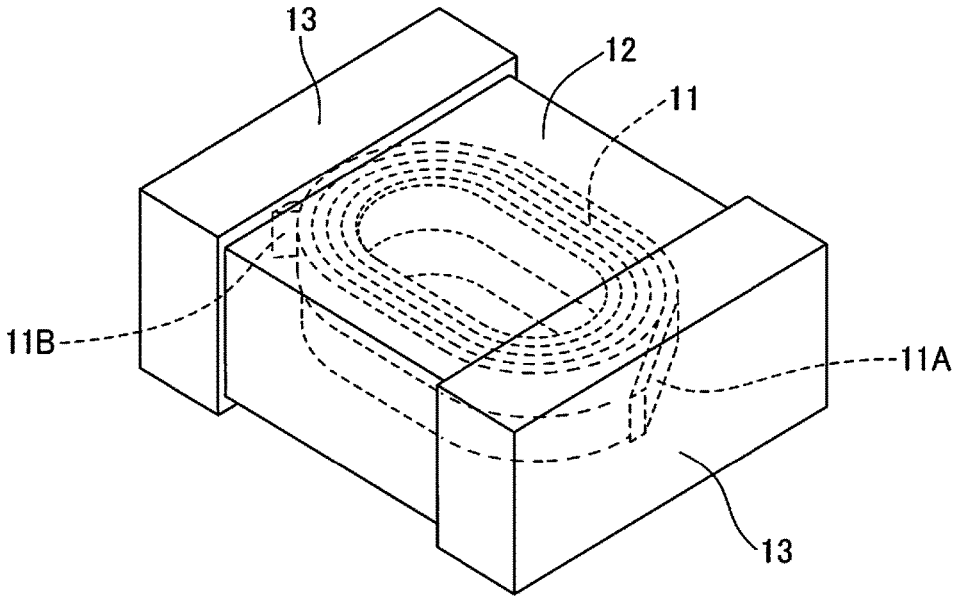
FIG. 1 is a perspective view illustrating a first embodiment of an electronic component of the present invention.
Figure 2:
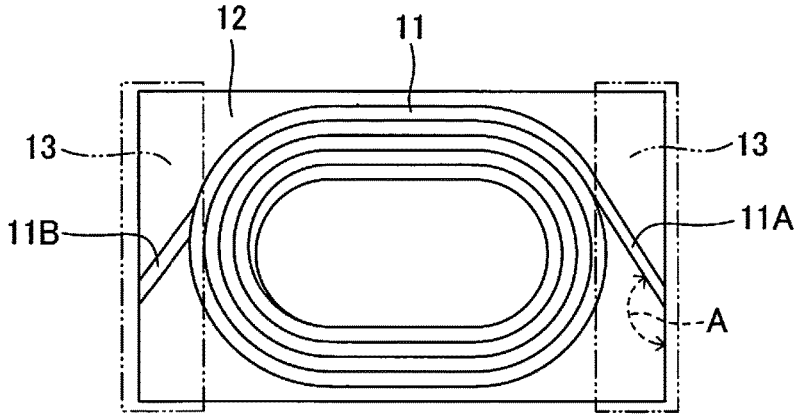
FIG. 2 is a top perspective view of a molded body from FIG. 1.

FIG. 1 is a perspective view illustrating a first embodiment of the electronic component of the present invention, and FIG. 2 is a top perspective view of the molded body from FIG. 1.

In FIGS. 1 and 2, the reference numerals 11, 12 and 13 designate a coil, a molded body and an external terminal electrode, respectively.

The coil 11 is formed by winding an electrically-conductive wire in such a manner as to allow its led-out ends 11A, 11B to be positioned on an outer periphery of a wound portion, and by leading out the led-out ends 11A, 11B in opposite directions with each other from the outer periphery of the wound portion. As the electrically-conductive wire, a rectangular wire applied with an insulating coating is used. The rectangular wire is wound in two tiers so as to allow its width direction to be parallel to a winding axis of the coil. Each of the led-out ends 11A, 11B is led out from the outer periphery of the wound portion in such a manner as to allow its led-out angle A to be greater than 90 degrees with respect to an end surface of the molded body 12 described below. At this time, each of the led-out ends 11A, 11B is formed to have no discontinuous bentness. Further, the edge of each of the led-out ends 11A, 11B is formed by obliquely cutting the electrically-conductive wire with respect to a surface thereof.

The molded body 12 is formed from a composite magnetic material containing a magnetic powder and a resin, and the coil 11 is buried in the molded body. As the magnetic powder, a metallic magnetic powder, for example, is used. As the resin, an epoxy resin, for example, is used. On the end surface of the molded body 12, a cut surface at an edge of each of the led-out ends 11A, 11B of the coil 11 is exposed, which is formed by obliquely cutting the electrically-conductive wire with respect to the surface thereof. Further, external terminal electrode 13 is formed in the end surface of the molded body 12. The external terminal electrode 13 is joined to the led-out ends of the coil, with the entire cut surface at the edge of each of the led-out ends 11A, 11B of the coil 11 being in contact with the external terminal electrode 13.

Such an electronic component is fabricated in the following manner. First, an electrically-conductive wire is wound in such a manner as to allow its led-out ends 11A, 11B to be positioned on an outer periphery of a wound portion. The led-out ends 11A, 11B are led out in opposite directions with each other from the outer periphery of the wound portion, and in such a manner as to allow its led-out angle A to be greater than 90 degrees with respect to an end surface of the molded body 12 described below. The wound portion and the led-out ends 11A, 11B form a coil 11.

Then, a plate-like composite magnetic material for which a composite magnetic material containing a magnetic powder and a resin is formed into a plate is softened, and in this condition, the side of led-out end 11B of the coil 11 is pressed into the plate-like composite magnetic material in such a manner as to allow the winding axis of the coil 11 to be perpendicular to the plate-like composite magnetic material, to thereby form a plate-like composite magnetic material in which each of a plurality of coils 11 is partially buried.

Subsequently, the side of led-out end 11A of each of the plurality of coils 11 protruding from the plate-like composite magnetic material is coated with other softened plate-like composite magnetic material, and then the entirety is pressurized and cured in a mold etc. This is cut off at a predetermined position using a cutting device to form a molded body 12. On the end surface of the molded body 12, a cut surface at an edge of each of the led-out ends 11A, 11B of the coil 11 is exposed, which is formed by obliquely cutting the electrically-conductive wire with respect to the surface thereof.

Further, an electrically-conductive paste is applied or an electrically-conductive material is provided through a sputtering or plating process, etc. on the end surface of the molded body 12 to form an external terminal electrode 13.

Then, the coil 11 is joined to the external terminal electrode 13, with the cut surface at the edge of each of the led-out ends 11A, 11B of the coil 11 being in contact with the external terminal electrode 13 in its entirety.

In the electronic component of the present invention formed in this way, when an electrically-conductive wire having a thickness of 50 μm is used, and the led-out angle A of each of the led-out ends 11A, 11B with respect to the end surface of the molded body 12 is varied as 150 degrees and 160 degrees, then the thickness of the cut surface at the edge of each of the led-out ends 11A, 11B is about 99 μm and 144 μm, respectively. Therefore, the electronic component of the present invention makes it possible to allow the area of the cut surface at the edge of each of the led-out ends 11A, 11B of the coil to be enlarged to 1.98 times when the led-out angle A is 150 degrees, and to 2.88 times when the led-out angle A is 160 degrees. This also makes it possible to allow the contact area of the edge of each of the led-out ends 11A, 11B of the coil with the external terminal electrode 13 to be enlarged to 1.98 times when the led-out angle A is 150 degrees, and to 2.88 times when the led-out angle A is 160 degrees.

Second Embodiment

Figure 3:
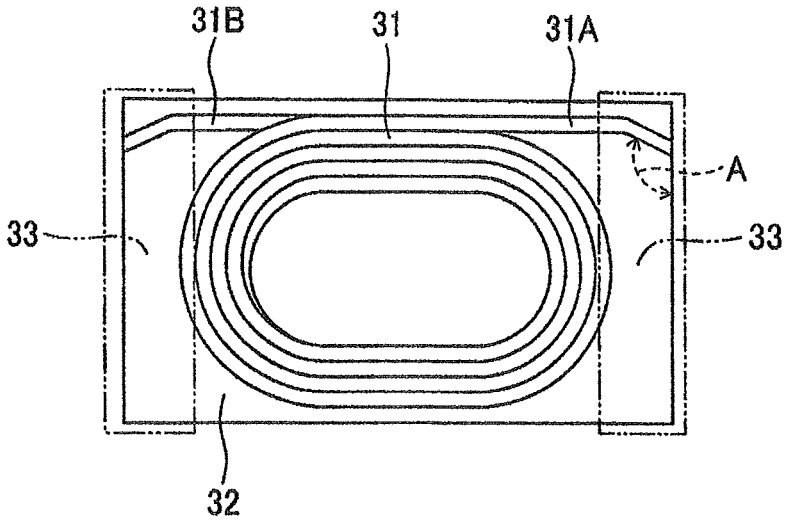
FIG. 3 is a top perspective view of a molded body in a second embodiment of the electronic component of the present invention.
Figure 4:
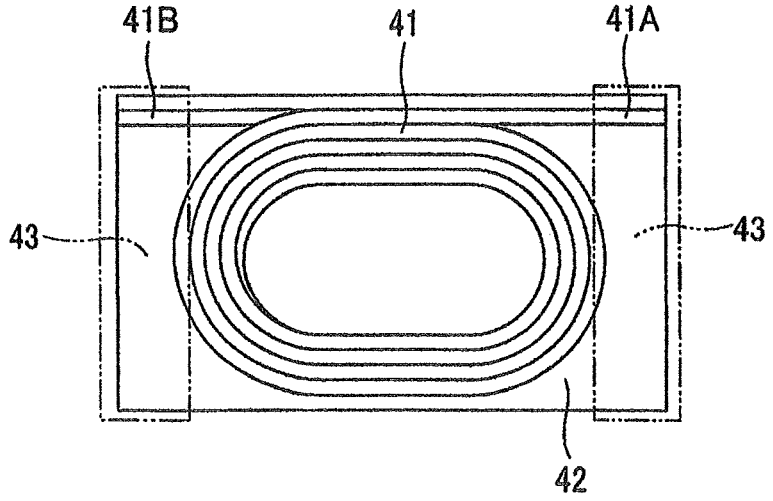
FIG. 4 is a top perspective view of a molded body of a conventional electronic component.

FIG. 3 is a top perspective view of a second embodiment of the electronic component of the present invention.

The coil 31 is formed by winding an electrically-conductive wire in such a manner as to allow its led-out ends 31A, 31B to be positioned on an outer periphery of a wound portion, and by leading out the led-out ends 31A, 31B in opposite directions with each other from the outer periphery of the wound portion. Each of the led-out ends 31A, 31B is led out from the outer periphery of the wound portion at a right angle with respect to an end surface of the molded body 32 described below, and applied with bending treatment at its distal end portion. Further, the edge of each of the led-out ends 31A, 31B is formed by obliquely cutting the electrically-conductive wire with respect to a surface thereof. When the coil 31 is formed in this way, it is also possible to allow the led-out angle A of each of the led-out ends 31A, 31B to be greater than 90 degrees with respect to an end surface of the molded body 32 described below.

The molded body 32 is formed from a composite magnetic material containing a magnetic powder and a resin, and the coil 31 is buried in the molded body. On the end surface of the molded body 32, a cut surface at an edge of each of the led-out ends 31A, 31B of the coil 31 is exposed, which is formed by obliquely cutting the electrically-conductive wire with respect to the surface thereof. Further, external terminal electrode 33 is formed in the end surface of the molded body 32. The external terminal electrode 33 is joined to the led-out ends of the coil 31, with the entire cut surface at the edge of each of the led-out ends 31A, 31B of the coil 31 being in contact with the external terminal electrode 33.

Alternative Embodiment

While the embodiments of the electronic component of the present invention have been described above, the present invention is not limited thereto. For example, a case is described where a plurality of coils are buried in the plate-like composite magnetic material to form the plurality of coils together, and then the plate-like composite magnetic material is cut to fabricate a plurality of electronic components. Alternatively, it is also possible to bury one coil in the plate-like composite magnetic material to fabricate one electronic component.

The led-out ends of the coil in the molded body may be formed by obliquely cutting the electrically-conductive wire with respect to a surface thereof by means of machining process such as polishing.

For the coil, a rectangular wire applied with an insulating coating may be used as the electrically-conductive wire, and wound in such a manner as to allow its thickness direction to be parallel to the winding axis of the coil. Further, an electrically-conductive wire having a rounded cross-section may be used.

The magnetic powder that makes up the molded body is only required to have a magnetic property, and any powders such as ferrite powder or various type of metallic magnetic powder may appropriately be used according to the required characteristics. Further, for the resin that makes up the molded body, any resins may appropriately be used according to the required characteristics.

LIST OF REFERENCE SIGNS

11: coil
12: molded body
13: external terminal electrode

The invention claimed is:

1. An electronic component comprising a coil formed by winding an electrically-conductive wire and a molded body formed from a composite magnetic material containing a magnetic powder and a resin, in which the coil is buried in the molded body, wherein the coil has led-out ends, each having a cut surface formed by obliquely cutting the electrically-conductive wire with respect to a surface thereof, and wherein the cut surface is exposed on a surface of the molded body, and each of the led-out ends is connected to an external terminal electrode formed in the surface of the molded body at the cut surface, wherein a led-out angle A of each of the led-out ends with respect to the surface of the molded body is from 150 degrees to 160 degrees, and wherein each of the led-out ends have a bent portion in the molded body.

2. The electronic component as defined in claim 1, wherein the coil is formed by winding an electrically-conductive wire to allow its led-out ends to be positioned on an outer periphery of a wound portion, and leading out the led-out ends from the outer periphery of the wound portion in opposite directions with respect to each other.

3. The electronic component as defined in claim 1, wherein the cut surface of each of the led-out ends of the coil is in contact with the external terminal electrode in its entirety.

4. The electronic component as defined in claim 2, wherein the cut surface of each of the led-out ends of the coil is in contact with the external terminal electrode in its entirety.

5. An electronic component comprising: a coil formed by winding an electrically-conductive wire; and a molded body formed from a composite magnetic material containing a magnetic powder and a resin, in which the coil is buried in the molded body, wherein the coil has led-out ends, each having a cut surface formed by obliquely cutting the electrically-conductive wire with respect to a surface thereof, wherein each of the led-out ends of the coil is led out from an outer periphery of a wound portion of the coil in such a manner as to allow its led-out angle to be 150 degrees to 160 degrees with respect to a surface of the molded body, wherein the cut surface is exposed on a surface of the molded body, and each of the led-out ends is connected to an external terminal electrode formed in the surface of the molded body at the cut surface, and wherein each of the led-out ends have a bent portion in the molded body.

6. The electronic component as defined in claim 5, wherein the coil is formed by winding an electrically-conductive wire to allow its led-out ends to be positioned on an outer periphery of a wound portion, and leading out the led-out ends from the outer periphery of the wound portion in opposite directions with respect to each other.

7. The electronic component as defined in claim 5, wherein the cut surface of each of the led-out ends of the coil is in contact with the external terminal electrode in its entirety.

8. The electronic component as defined in claim 6, wherein the cut surface of each of the led-out ends of the coil is in contact with the external terminal electrode in its entirety.

* * * * *